US008256226B2

(12) United States Patent
Khan et al.

(10) Patent No.: US 8,256,226 B2
(45) Date of Patent: Sep. 4, 2012

(54) RADIAL LEAN DIRECT INJECTION BURNER

(75) Inventors: Abdul Rafey Khan, Greenville, SC (US); Gilbert Otto Kraemer, Greer, SC (US); Christian Xavier Stevenson, Inman, SC (US)

(73) Assignee: General Electric Company, Schenectady, NY (US)

( * ) Notice: Subject to any disclaimer, the term of this patent is extended or adjusted under 35 U.S.C. 154(b) by 650 days.

(21) Appl. No.: 12/428,690

(22) Filed: Apr. 23, 2009

(65) Prior Publication Data

US 2010/0269507 A1 Oct. 28, 2010

(51) Int. Cl.
*F02C 1/00* (2006.01)

(52) U.S. Cl. ..... 60/772; 60/740; 60/742; 60/746; 60/747; 60/748

(58) Field of Classification Search ..... 60/740, 60/742, 746, 747, 748, 772, 776
See application file for complete search history.

(56) References Cited

U.S. PATENT DOCUMENTS

| | | | | |
|---|---|---|---|---|
| 3,866,411 | A * | 2/1975 | Marion et al. | 60/780 |
| 4,761,948 | A * | 8/1988 | Sood et al. | 60/39.281 |
| 5,259,184 | A | 11/1993 | Borkowicz et al. | |
| 5,394,688 | A * | 3/1995 | Amos | 60/39.23 |
| 5,490,378 | A | 2/1996 | Berger et al. | |
| 5,675,971 | A * | 10/1997 | Angel et al. | 60/746 |
| 5,778,676 | A | 7/1998 | Joshi et al. | |
| 6,301,899 | B1 | 10/2001 | Dean et al. | |
| 6,438,961 | B2 | 8/2002 | Tuthill et al. | |
| 6,681,578 | B1 | 1/2004 | Bunker | |
| 6,799,427 | B2 * | 10/2004 | Calvez et al. | 60/737 |
| 6,871,501 | B2 * | 3/2005 | Bibler et al. | 60/772 |
| 6,993,916 | B2 | 2/2006 | Johnson et al. | |
| 2008/0078181 | A1 * | 4/2008 | Mueller et al. | 60/776 |
| 2009/0212139 | A1 * | 8/2009 | Thomson et al. | 239/590 |

* cited by examiner

*Primary Examiner* — Ehud Gartenberg
*Assistant Examiner* — Lorne Meade
(74) *Attorney, Agent, or Firm* — Nixon & Vanderhye, P.C.

(57) ABSTRACT

A burner for use in a gas turbine engine includes a burner tube having an inlet end and an outlet end; a plurality of air passages extending axially in the burner tube configured to convey air flows from the inlet end to the outlet end; a plurality of fuel passages extending axially along the burner tube and spaced around the plurality of air passage configured to convey fuel from the inlet end to the outlet end; and a radial air swirler provided at the outlet end configured to direct the air flows radially toward the outlet end and impart swirl to the air flows. The radial air swirler includes a plurality of vanes to direct and swirl the air flows and an end plate. The end plate includes a plurality of fuel injection holes to inject the fuel radially into the swirling air flows. A method of mixing air and fuel in a burner of a gas turbine is also provided. The burner includes a burner tube including an inlet end, an outlet end, a plurality of axial air passages, and a plurality of axial fuel passages. The method includes introducing an air flow into the air passages at the inlet end; introducing a fuel into fuel passages; swirling the air flow at the outlet end; and radially injecting the fuel into the swirling air flow.

18 Claims, 9 Drawing Sheets

RADIAL LEAN DIRECT INJECTION BURNER

This invention was made with Government support under Contract No. DE-FC26-05NT42643 awarded by the Department of Energy. The Government has certain rights in this invention.

FIELD OF THE INVENTION

The present invention relates to an air fuel mixer for the combustor of a gas turbine engine, and to a method for mixing air and fuel.

BACKGROUND OF THE INVENTION

Gas turbine manufacturers are regularly involved in research and engineering programs to produce new gas turbines that will operate at high efficiency without producing undesirable air polluting emissions. The primary air polluting emissions usually produced by gas turbines burning conventional hydrocarbon fuels are oxides of nitrogen, carbon monoxide, and unburned hydrocarbons. The oxidation of molecular nitrogen in air breathing engines is highly dependent upon the maximum hot gas temperature in the combustion system reaction zone. The rate of chemical reactions forming oxides of nitrogen (NOx) is an exponential function of temperature. If the temperature of the combustion chamber hot gas is controlled to a sufficiently low level, thermal NOx produced will be at a much lower rate.

One method of controlling the temperature of the reaction zone of a combustor below the level at which thermal NOx is formed is to premix fuel and air to a lean mixture prior to combustion. The thermal mass of the excess air present in the reaction zone of a lean premixed combustor absorbs heat and reduces the temperature rise of the products of combustion to a level where thermal NOx is not formed at an acceptable rate to remain in emission compliance.

There are several problems associated with dry low emissions combustors operating with lean premixing of fuel and air in which flammable mixtures of fuel and air exist within the premixing section of the combustor, which is external to the reaction zone of the combustor. There is a tendency for combustion to occur within the premixing section due to flashback, which occurs when flame propagates from the combustor reaction zone into the premixing section and causes the flame to hold inside the wake flows behind the fuel injection columns (jet cross flow) or vane trailing edges, or autoignition, which occurs when the dwell time and temperature for the fuel/air mixture in the premixing section are sufficient for combustion to be initiated without an igniter. The consequences of combustion in the premixing section are degradation of emissions performance and/or overheating and damage to the premixing section, which is typically not designed to withstand the heat of combustion. Therefore, a problem to be solved is to prevent flashback or autoignition resulting in combustion within the premixer.

In addition, the mixture of fuel and air exiting the premixer and entering the reaction zone of the combustor must be very uniform to achieve the desired emissions performance. If regions in the flow field exist where fuel/air mixture strength is significantly richer than average, the products of combustion in these regions will reach a higher temperature than average, and thermal NOx will be formed. This can result in failure to meet NOx emissions objectives depending upon the combination of temperature and residence time. If regions in the flow field exist where the fuel/air mixture strength is significantly leaner than average, then quenching may occur with failure to oxidize hydrocarbons and/or carbon monoxide to equilibrium levels. This can result in failure to meet carbon monoxide (CO) and/or unburned hydrocarbon (UHC) emissions objectives. Thus, another problem to be solved is to produce a fuel/air mixture strength distribution, exiting the premixer, which is sufficiently uniform to meet emissions performance objective's.

Still further, in order to meet the emissions performance objectives imposed upon the gas turbine in many applications, it is necessary to reduce the fuel/air mixture strength to a level that is close to the lean flammability limit for most hydrocarbon fuels. This results in a reduction in flame propagation speed as well as emissions. As a consequence, lean premixing combustors tend to be less stable than more conventional diffusion flame combustors, and high level combustion driven dynamic pressure fluctuation (dynamics) often results. Dynamics can have adverse consequences such as combustor and turbine hardware damage due to wear or fatigue, flashback or blow out. Accordingly, another problem to be solved is to control the combustion dynamics to an acceptably low level.

Lean, premixing fuel injectors for emissions abatement are in use throughout the industry, having been reduced to practice in heavy duty industrial gas turbines for more than two decades. A representative example of such a device is described in U.S. Pat. No. 5,259,184. Such devices have achieved progress in the area of gas turbine exhaust emissions abatement. Reduction of oxides of nitrogen, NOx, emissions by an order of magnitude or more relative to the diffusion flame burners of the prior art have been achieved without the use of diluent injection such as steam or water.

As noted above, however, these gains in emissions performance have been made at the risk of incurring several problems. In particular, flashback and flame holding within the premixing section of the device result in degradation of emissions performance and/or hardware damage due to overheating. In addition, increased levels of combustion driven dynamic pressure activity results in a reduction in the useful life of combustion system parts and/or other parts of the gas turbine due to wear or high cycle fatigue failures. Still further, gas turbine operational complexity is increased and/or operating restrictions on the gas turbine are necessary in order to avoid conditions leading to high-level dynamic pressure activity, flashback, or blow out.

In addition to these problems, conventional lean premixed combustors have not achieved maximum emission reductions possible with perfectly uniform premixing of fuel and air.

BRIEF DESCRIPTION OF THE INVENTION

According to one embodiment of the invention, a burner for use in a gas turbine engine comprises a burner tube having an inlet end and an outlet end; a plurality of air passages extending axially in the burner tube configured to convey air flows from the inlet end to the outlet end; a plurality of fuel passages extending axially along the burner tube and spaced around the plurality of air passage configured to convey fuel from the inlet end to the outlet end; and a radial air swirler provided at the outlet end configured to direct the air flows radially toward the outlet end and impart swirl to the air flows. The radial air swirler comprises a plurality of vanes to direct and swirl the air flows and an end plate. The end plate comprises a plurality of fuel injection holes to inject the fuel radially into the swirling air flows.

According to another embodiment of the invention, a method of mixing air and fuel in a burner of a gas turbine is provided. The burner comprises a burner tube comprising an inlet end, an outlet end, a plurality of axial air passages, and a plurality of axial fuel passages. The method comprises introducing an air flow into the air passages at the inlet end; introducing a fuel into fuel passages; swirling the air flow at the outlet end; and radially injecting the fuel into the swirling air flow.

DETAILED DESCRIPTION OF THE INVENTION

Figure 1:
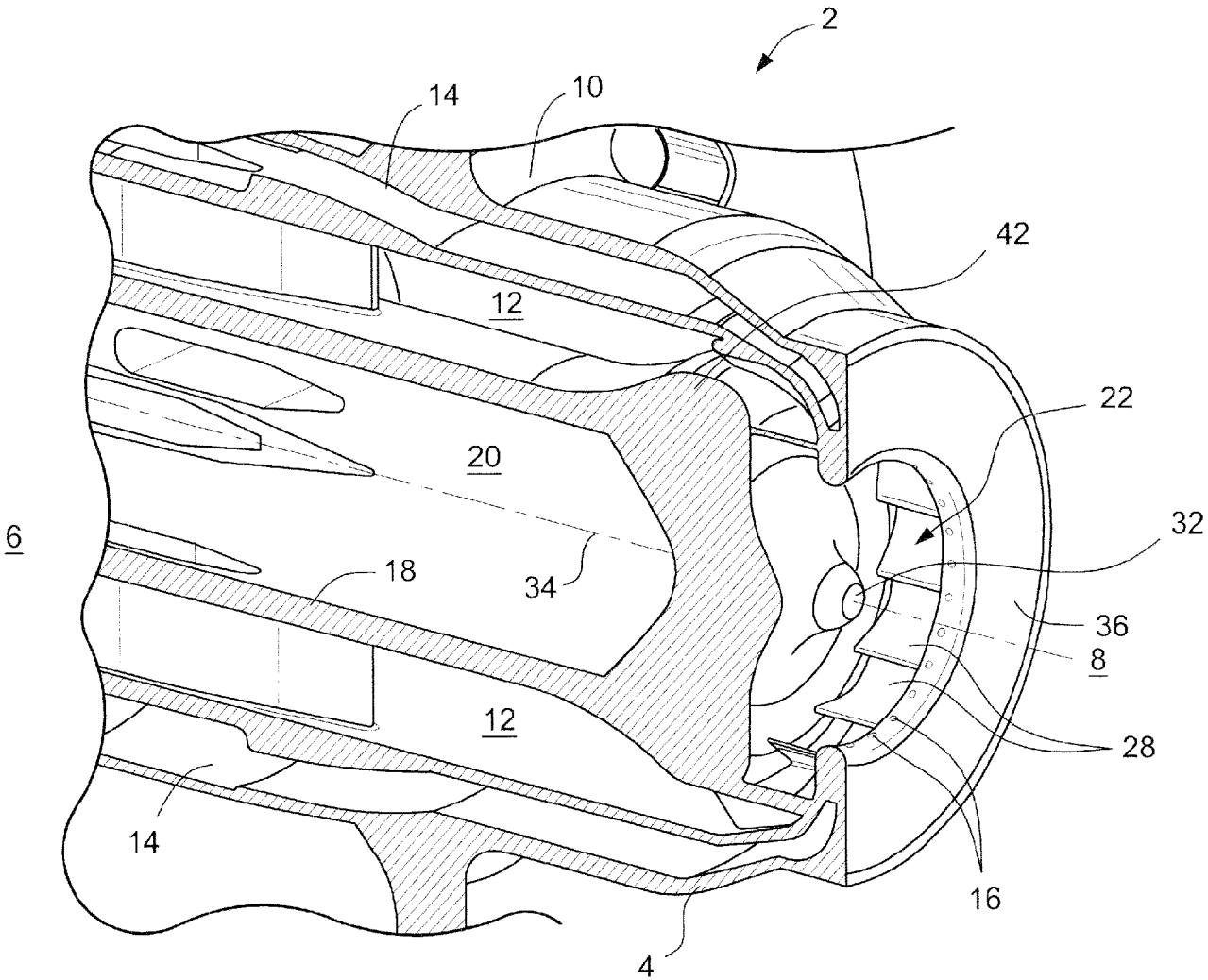
FIGS. 1-5 schematically depict a burner according to an embodiment.

Referring to FIGS. 1-5, a burner 2 comprises a burner tube 4 having an inlet end 6 and an outlet end 8. A flange 10 is provided to the burner tube 4 for mounting the burner 2 into a gas turbine engine. It should be appreciated that the flange 10 may be integrally formed with the burner tube 4, or may be provided separately. It should also be appreciated that other mounting arrangements may be provided for the burner 2.

Figure 2:
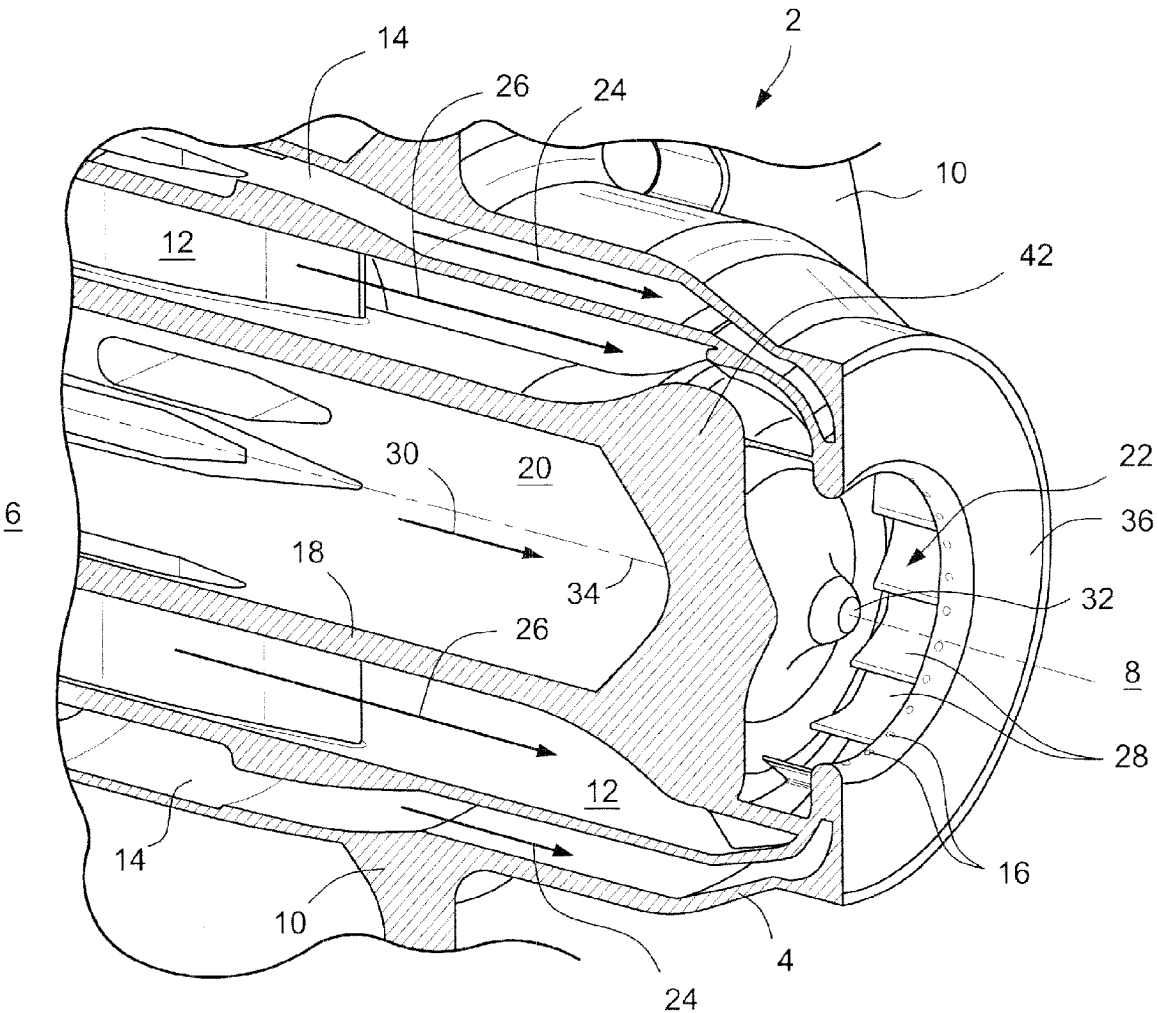
Figure 3:
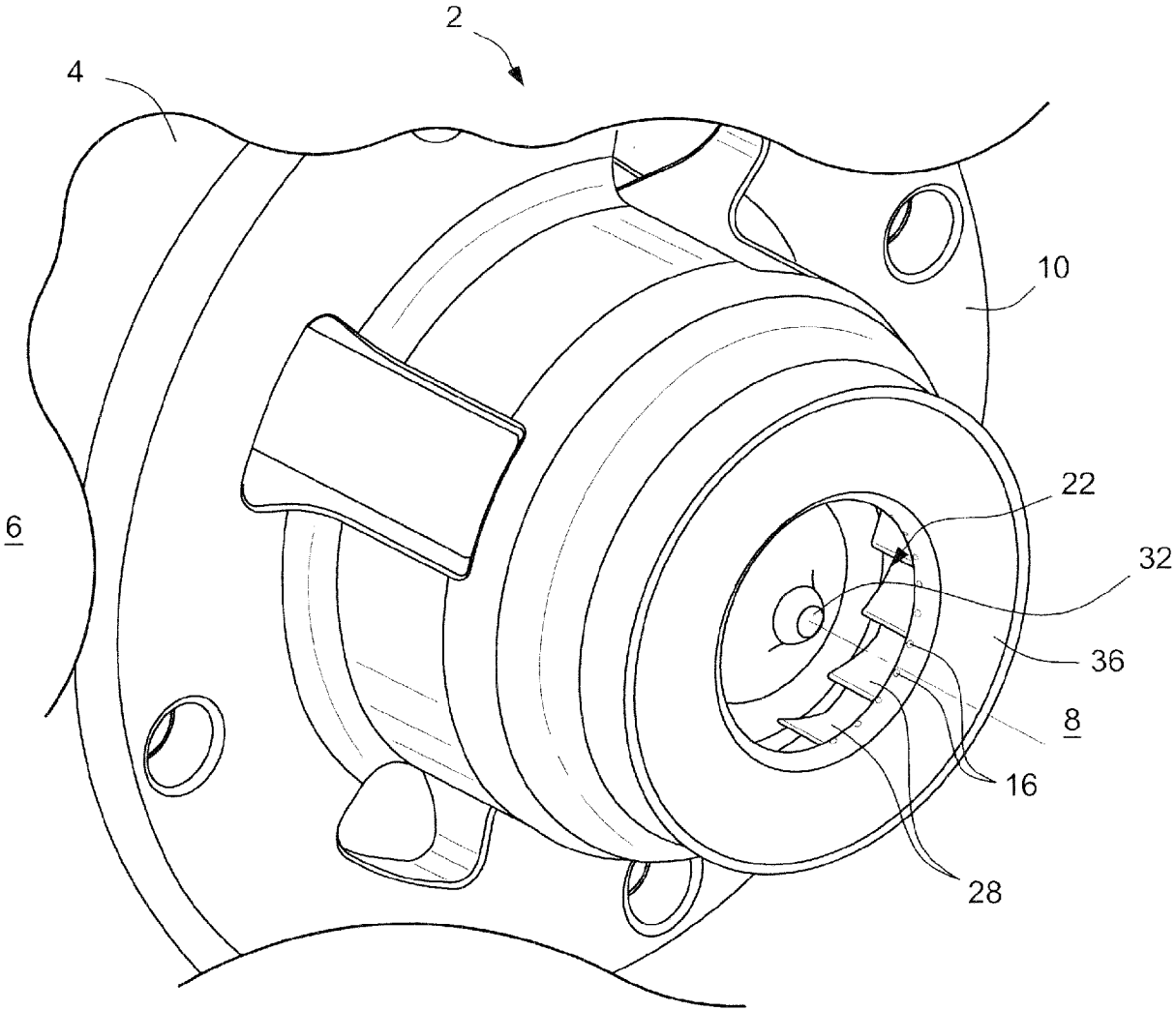
Figure 4:
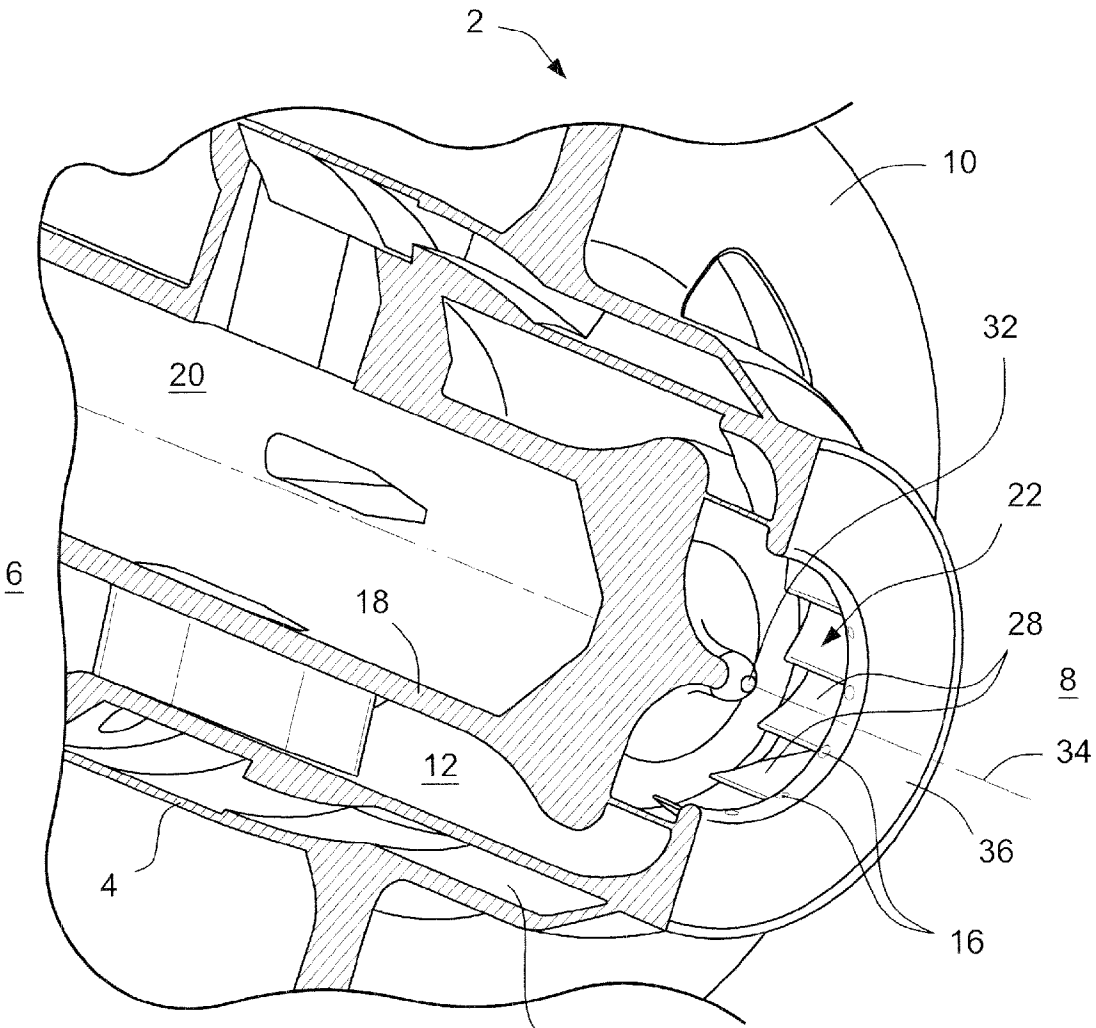
Figure 5:
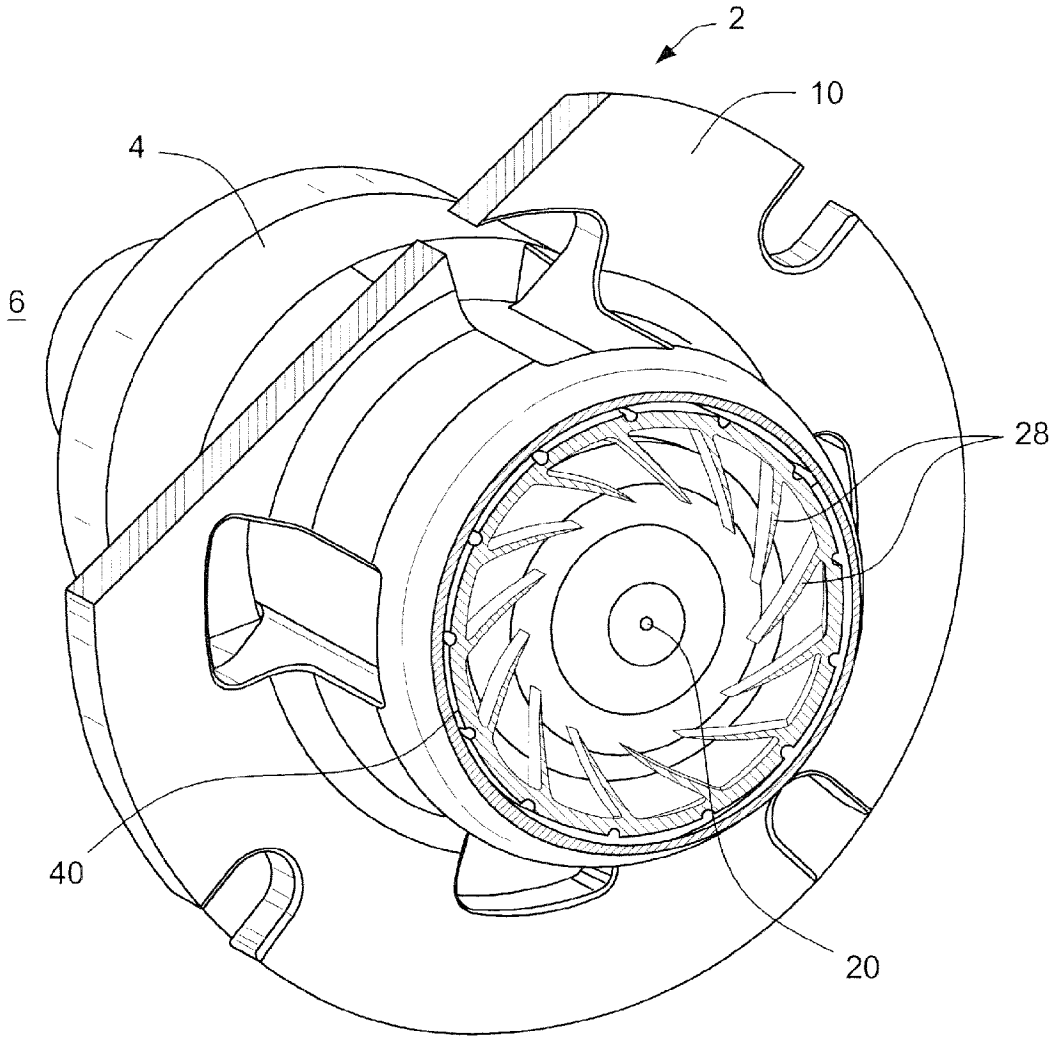

The burner tube 4 comprises a plurality of air passages 12. The air passages 12 surround a central body 18 that comprises a central passage 20. The central body 18 is coaxial with an axis 34 of the burner tube 4. A plurality of fuel passages 14 are provided around the air passages 12. A radial air swirler arrangement 22 is provided at the outlet end 8 of the burner 2 to impart a swirl to the air flow 26 (FIG. 2). The radial air swirler arrangement 22 comprises a plurality of vanes 28 that are provided around the circumference of the outlet end 8 in between a front plate 36 and a central body tip 32 of the central body 18.

A plurality of fuel injection holes 16 are provided in the front plate 36 to inject fuel radially into the burner tube 4 from the fuel passages 14. The injected fuel 24 from the fuel passages 14 is mixed with the air flow 26 that is swirled by the vanes 28 of the radial air swirler arrangement 22. The fuel 24 is injected into the air flow where most of the air mass flow is concentrated in the thin annulus section 40 (FIG. 5) at the outlet end 8 of the burner 2. Injected fuel 30 is also provided from the central passage 20 of the central body 18 through the central body tip 32. As the air and fuel are not premixed, flame holding is reduced, or eliminated. The front plate 36 is also cooled by the air flow, and the vanes 28 act like fins to aid in heat transfer.

The central body 18 includes an end portion 42 that is configured to cut back a recirculation zone and accelerate the air flow 26 that might otherwise carry hot combustion products or reactants back into the burner tube 4 that could create local hot spots and result in damage. The central body 18 may be utilized for starting up on a second fuel or backup fuel, for example natural gas. It should be appreciated that the central body 18 may also be replaced by a liquid fuel cartridge or atomizer assembly for liquid fuels.

The injected fuel 24, 30 may be highly reactive fuel, for example pure hydrogen or various hydrogen/CO and hydrocarbon mixtures. Injecting the fuel 24, 30 in the radial swirling air flow provides rapid air fuel mixing that reduces emissions and prevents unpredictable flame holding and flash backs that may occur in premixed combustion systems.

It is possible to vary the fuel locations and penetration depths that will provide more control over the fuel distribution and mixing to reduce and control emissions. The fuel location can be changed depending on the reactivity of the fuels to provide distribution and mixing necessary for attaining low emissions.

Figure 6:
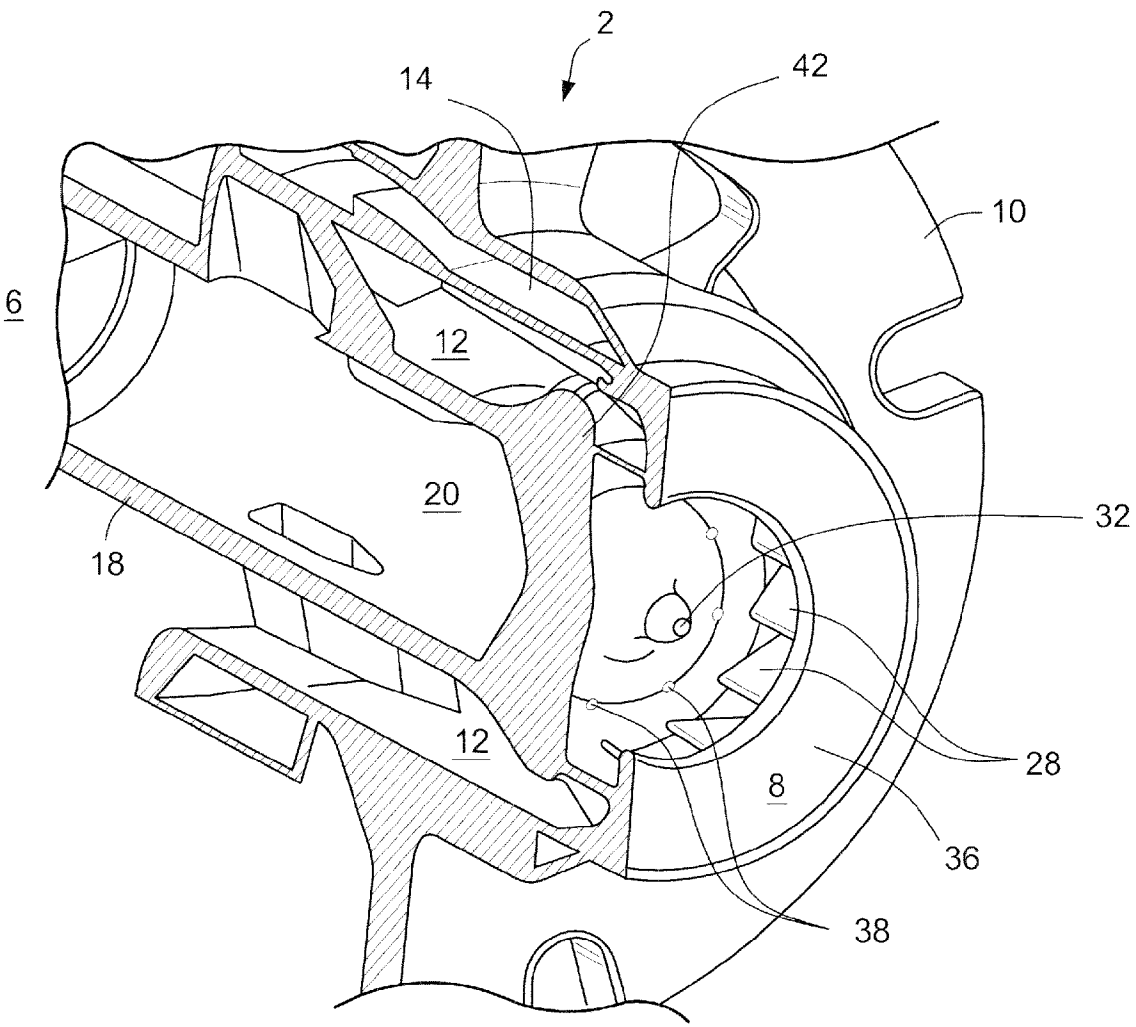
FIG. 6 schematically depicts a burner according to another embodiment.

Referring to FIG. 6, a burner 2 according to another embodiment comprises a plurality of fuel injection holes 38 provided around the central body tip 32.

Figure 7:
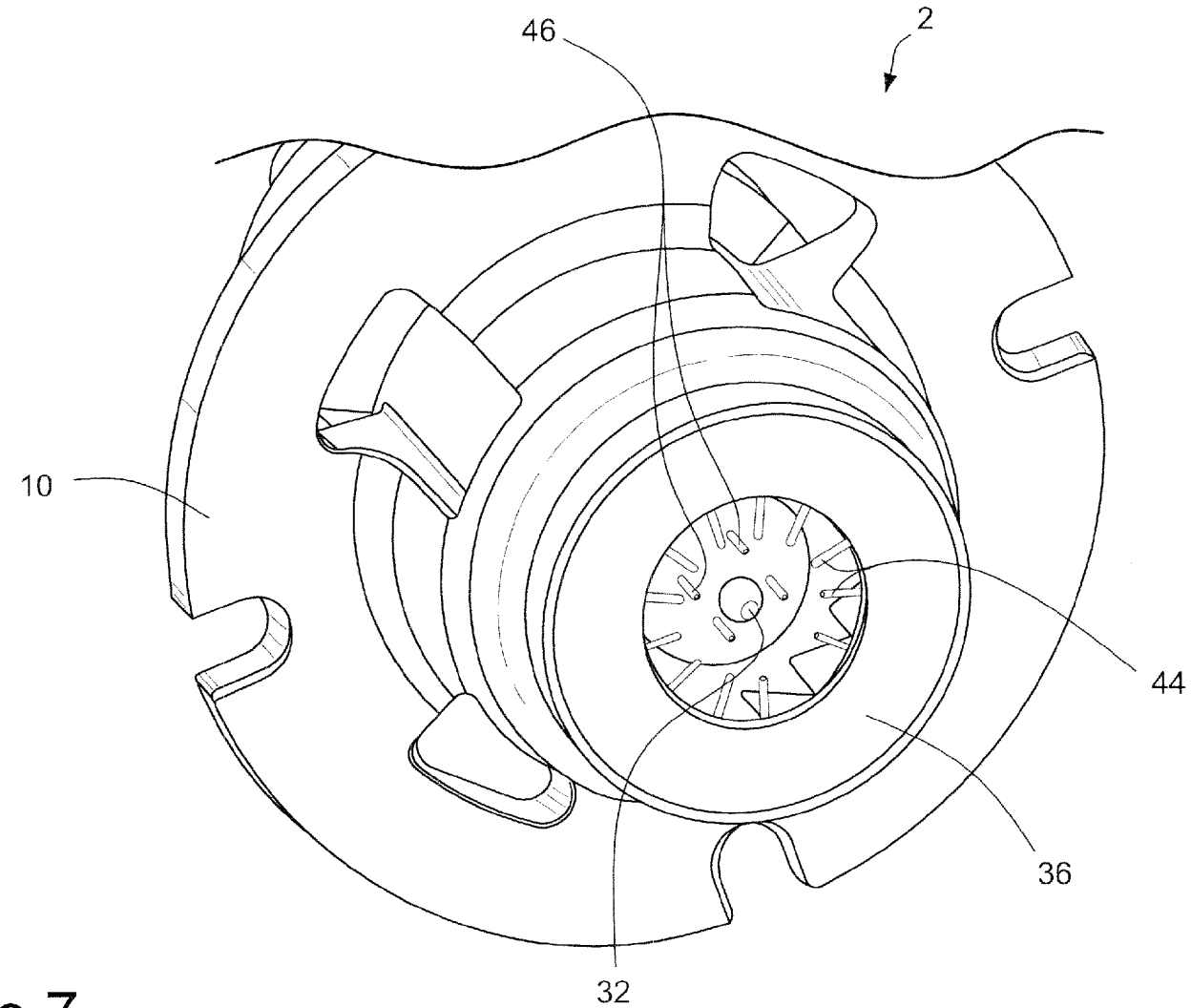
FIGS. 7 and 8 schematically depict a burner according to still another embodiment.
Figure 8:
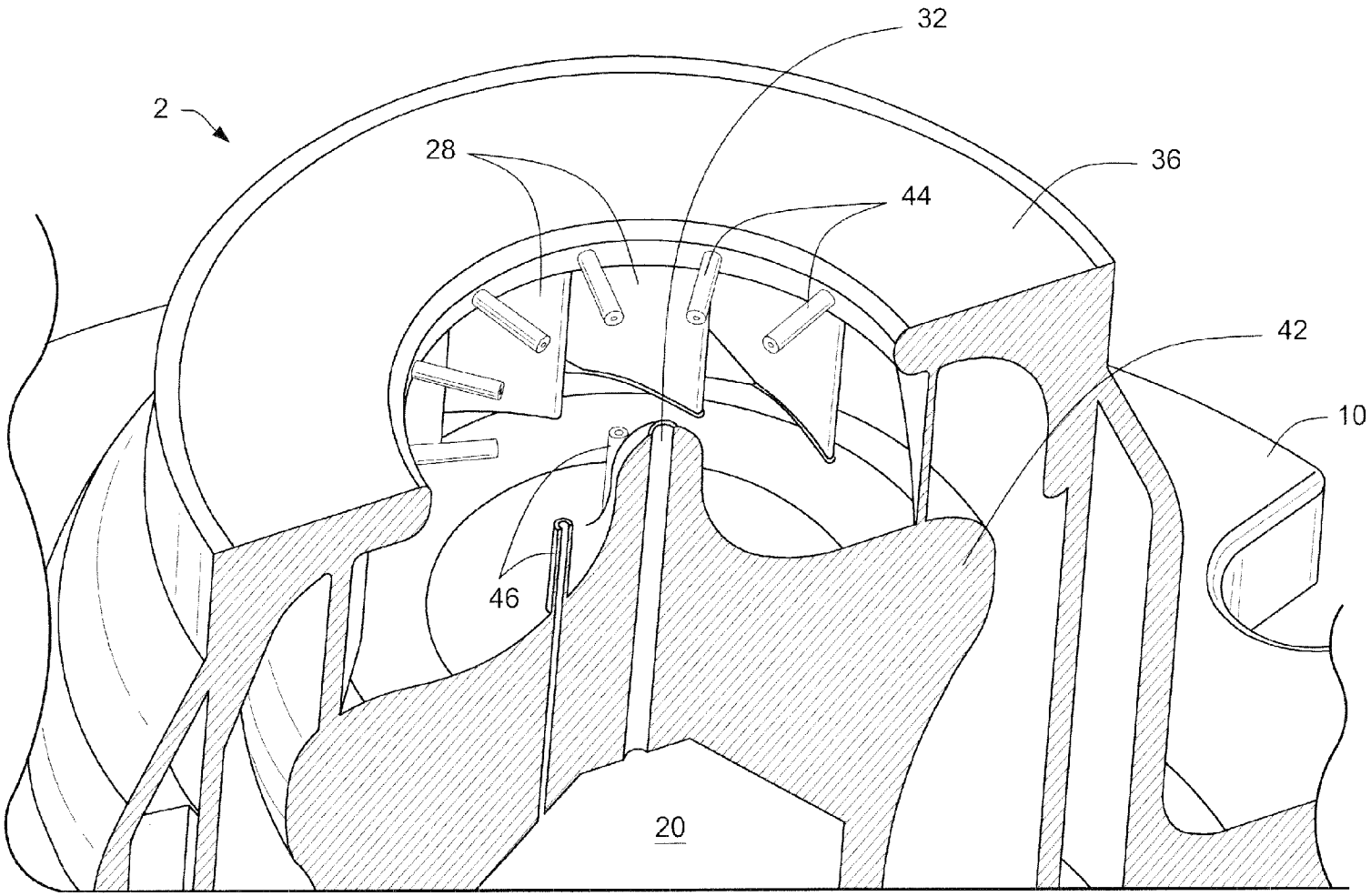

Referring to FIGS. 7 and 8, in another embodiment a burner 2 comprises a plurality of fuel injection tubes 44 provided around the periphery of the opening in the front plate 36. A plurality of fuel injection tubes 46 are provided around the central body tip 32.

Figure 9:
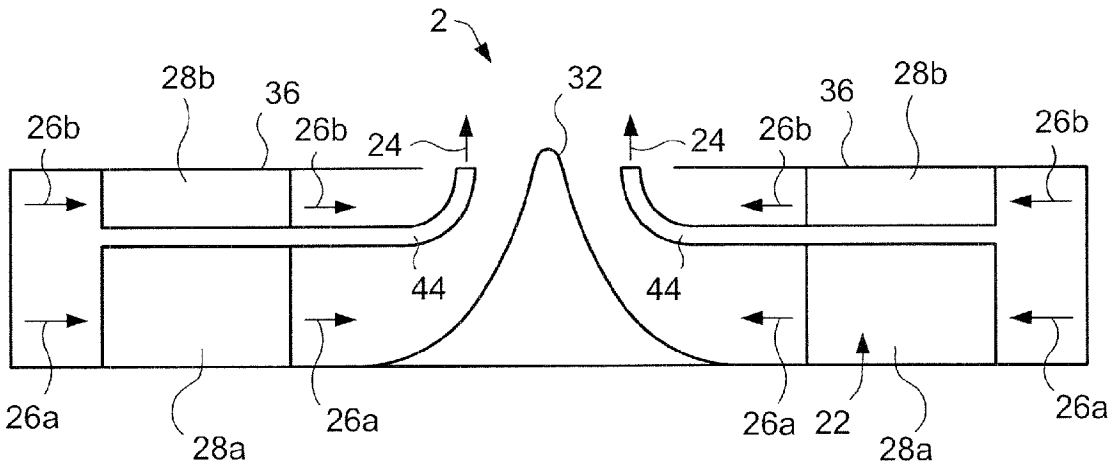
FIG. 9 schematically depicts a burner according to yet another embodiment.

As shown in FIG. 9, in another embodiment a burner 2 comprises a radial air swirler arrangement 22 that comprises vanes 28*a*, 28*b*. Fuel injection tubes 44 are provided between the vanes 28*a*, 28*b* to inject fuel 24 that mixes with the air flows 26 to form a fuel-air mixture. The front plate 36 may extend to a position in the vicinity of the outlet of the fuel injection annulus 44 to direct the air flow 26*b* swirled by the vanes 28*b* into mixing with the fuel 24 from the fuel orifices. The air flow 26*b* provided by the vanes 28*b* and the fuel 24 from the fuel injection tubes 44 forms a first fuel injection annulus and the air flow 26*a* provided by the vanes 28*a* and the fuel 24 from the fuel injection tubes 44 forms a second fuel injection annulus. Two radial air swirlers are shown in FIG. 9, however it should be appreciated that more than two radial air swirlers may be provided.

Figure 10:
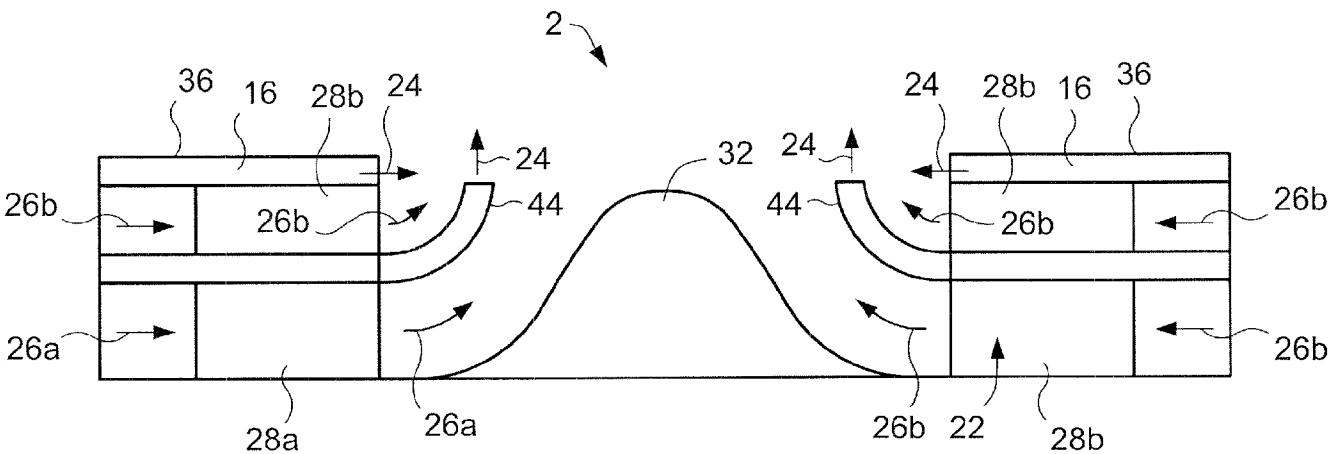
FIG. 10 schematically depicts a burner according to an even further embodiment.

Referring to FIG. 10, according to another embodiment, the burner 2 comprises fuel injection holes 16 in the front plate 36 in addition to the fuel annulus with fuel injection orifices at exit 44 provided between the vanes 28*a*, 28*b* of the radial air swirler arrangement 22. The fuel 24 from the fuel injection holes 16 and the fuel 24 from the fuel injection tubes 44 forms a first fuel injection annulus with the air flow 26*b* swirled by the vanes 28*b*. The fuel 24 from the fuel injection tubes 44 also forms a second fuel injection annulus with the air flow 26*a* swirled by the vanes 28*a*.

Radial lean direct injection may comprise more than one swirler and fuel injection annulus to enhance mixing and tailor the combustor aerodynamic flow field, as shown in FIGS. 9 and 10. The fuel injection annuluses between the radial swirlers may enable more rapid mixing with the air than the fuel annulus near the exit in part due to enhanced air shearing. The fuel injection tubes between the radial swirlers may be less exposed to the combustor flame zone and decrease any thermal degradation of the fuel, and hence fuel coking. As shown in FIGS. 9 and 10, two fuel injection annuluses may be provided to reduce the size of fuel rich, high temperature combustion zone for lower NOx. It should be appreciated that more than two fuel injection annuluses may be provided. Additional fuel injection annuluses may enable use of fuels with wide range of Wobbe numbers and reaction rates while maintaining acceptable dynamics, fuel compression costs, durability and emissions. Plural radial swirlers may provide additional latitude for trade off between turn down, emissions, wall heating, exit temperature profile, and fuel flexibility.

The radial lean direct injection burner may inject highly reactive fuels, such as pure hydrogen or various hydrogen/CO and hydrocarbon mixtures, in the radial swirling air flow field that provides rapid air fuel mixing necessary for reducing emissions and prevent unpredictable flame holding and flash back issues that poses challenge in premixed combustion systems.

Air is introduced radially and swirled, fuel is injected radially into the air stream where most of the air mass flow is concentrated in the thin annulus section at the exit section of the burner. The use of fuel injection tubes makes it possible to vary fuel locations and penetration depths that can give more control over fuel distribution and mixing to reduce and control emissions. The number and/or location of the fuel injection passages, either fuel injection holes and/or fuel injection tubes, may be designed to improve fuel distribution and mixing to attain lower emissions.

The radial injection of fuel into a swirling air flow may also be used as a premixer for premix combustor design systems.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A burner for use in a gas turbine engine, comprising:

a burner tube having an inlet end and an outlet end;

a plurality of air passages extending axially in the burner tube and configured to convey an air flow from the inlet end to the outlet end;

a plurality of fuel passages extending axially and circumferentially in the burner tube and spaced around the plurality of air passages and configured to convey fuel from the inlet end to the outlet end; and a radial air swirler provided at the outlet end configured to direct the air flow radially toward the outlet end and impart swirl to the air flow, the radial air swirler comprising a plurality of vanes to direct and swirl the air flow and an annular end plate downstream of the radial air swirler, wherein the end plate comprises a plurality of fuel injection passages circumferentially spaced and terminating at an inner circumference of the annular end plate to inject the fuel radially into the swirling air flow downstream of the radial air swirler.

2. A burner according to claim 1, further comprising:

a central body coaxially disposed in the burner tube between the inlet end and the outlet end.

3. A burner according to claim 2, wherein the central body comprises a central passage configured to convey fuel to a position adjacent the radial air swirler.

4. A burner according to claim 2, wherein the central body comprises an end portion adjacent the outlet end that is configured to accelerate the air flow.

5. A burner according to claim 3, wherein the central body comprises a plurality of fuel injection passages around the central passage.

6. A burner according to claim 5, wherein the fuel injection passages around the central passage comprise a plurality of fuel injection tubes.

7. A burner according to claim 6, wherein fuel injection passages of the end plate comprise a plurality of fuel injection tubes.

8. A burner according to claim 4, wherein the plurality of vanes further comprise a first plurality of vanes defining a first annulus and a second plurality of vanes defining a second annulus where a plurality of fuel injection tubes are provided between the first plurality of vanes and the second plurality of vanes.

9. A burner according to claim 8, wherein outlets of the fuel injection tubes are adjacent the end plate.

10. A method of mixing air and fuel in a burner of a gas turbine, the burner comprising a burner tube comprising an inlet end and an outlet end, a plurality of axial air passages extending axially from the inlet end to the outlet end, a plurality of axial fuel passages spaced around the plurality of air passages, a radial air swirler at the outlet end, and an annular end plate downstream of the radial air swirler, the method comprising:

introducing an air flow into the air passages at the inlet end;

introducing a fuel into the fuel passages;

swirling the air flow at the outlet end; and radially injecting the fuel into the swirling air flow from a plurality of fuel injection passages circumferentially spaced and terminating at an inner circumference of the annular end plate.

11. A method according to claim 10, further comprising:

introducing a second fuel into a central passage of a central body provided in the burner tube; and injecting the second fuel from the central body into the swirling air flow.

12. A method according to claim 11, further comprising:

injecting the second fuel into the swirling air flow from a plurality of fuel injection passages radially spaced from the central passage.

13. A method according to claim 12, wherein the plurality of fuel injection passages of the central body comprises a plurality of fuel injection tubes.

14. A method according to claim 13, wherein the plurality of fuel injection passages of the annular end plate comprises a plurality of fuel injection tubes.

15. A method according to claim 11, further comprising:

accelerating the air flow over an end of the central body adjacent the outlet end.

16. A method according to claim 10, wherein swirling the air flow at the outlet end comprises swirling the air flow in a first annulus and a second annulus.

17. A method according to claim 10, wherein the fuel comprises hydrogen or inert gas or gases, or hydrogen/CO, or hydrocarbon mixtures, or any combination thereof.

18. A method according to claim 11, wherein the second fuel comprises natural gas.

* * * * *

UNITED STATES PATENT AND TRADEMARK OFFICE

CERTIFICATE OF CORRECTION

PATENT NO. : 8,256,226 B2
APPLICATION NO. : 12/428690
DATED : September 4, 2012
INVENTOR(S) : Khan et al.

It is certified that error appears in the above-identified patent and that said Letters Patent is hereby corrected as shown below:

At column 2, line 8, delete "objective's" and insert --objectives--

Signed and Sealed this
Twenty-seventh Day of November, 2012

David J. Kappos

David J. Kappos
*Director of the United States Patent and Trademark Office*